US005310969A

United States Patent [19]

Turek et al.

[11] Patent Number: 5,310,969

[45] Date of Patent: May 10, 1994

[54] SWITCH LOCKOUTS

[75] Inventors: Mark E. Turek, Wheaton; Michael R. Schag, Hanover Park, both of Ill.

[73] Assignee: Prinzing Enterprises, Inc., Warrenville, Ill.

[21] Appl. No.: 871,388

[22] Filed: Apr. 21, 1992

[51] Int. Cl.[5] ..... H01H 9/28

[52] U.S. Cl. ..... 200/43.14; 200/43.19

[58] Field of Search ..... 200/43.14, 43.15, 43.19, 200/43.21

[56] References Cited

U.S. PATENT DOCUMENTS

| | | | |
|---|---|---|---|
| 1,154,389 | 9/1915 | Fogalsang . | |
| 1,439,552 | 12/1922 | Johnson . | |
| 1,829,444 | 10/1931 | Goebel et al. . | |
| 2,169,860 | 8/1939 | Von Hoorn . | |
| 2,795,663 | 6/1957 | Estes . | |
| 2,849,552 | 8/1958 | Firestone . | |
| 3,197,581 | 7/1965 | Clifford . | |
| 3,214,530 | 10/1965 | Tharp et al. . | |
| 3,245,240 | 4/1966 | Forrest . | |
| 3,255,320 | 6/1966 | Norden . | |
| 3,291,924 | 12/1966 | Tharp . | |
| 3,408,466 | 10/1968 | Palmer . | |
| 3,457,745 | 7/1969 | Barber . | |
| 3,678,228 | 7/1972 | Adamson . | |
| 3,982,602 | 9/1976 | Gorman . | |
| 4,158,116 | 6/1979 | Krueger . | |
| 4,160,137 | 7/1979 | Clement et al. . | |
| 4,347,412 | 8/1982 | Mihara et al. . | |
| 4,435,624 | 3/1984 | Sepulveda . | |
| 4,467,152 | 8/1984 | Gordy | 200/43.15 X |
| 4,538,434 | 9/1985 | Janzen, Sr. et al. | 200/43.15 X |
| 4,561,273 | 12/1985 | Robinson | 200/43.15 X |
| 4,570,470 | 2/1986 | Gray, Sr. | 200/43.15 X |
| 4,631,938 | 12/1986 | Johnson | 200/43.15 X |
| 4,677,261 | 6/1987 | Nourry | 200/43.15 X |
| 4,733,029 | 3/1988 | Kobayashi et al. | 200/43.15 X |
| 4,798,069 | 1/1989 | DeForrest, Sr. | 200/43.15 X |
| 4,876,867 | 10/1989 | Leneave . | |
| 4,882,456 | 11/1989 | Hovanic et al. . | |
| 4,897,515 | 1/1990 | Zubar et al. | 200/43.14 |
| 4,978,816 | 12/1990 | Castonguay et al. . | |
| 5,122,624 | 6/1992 | Benda | 200/43.14 |
| 5,147,991 | 9/1992 | Jordan, Sr. | 200/43.14 |
| 5,165,528 | 11/1992 | Kozlowski et al. | 200/43.15 |

*Primary Examiner*—Renee S. Luebke

*Attorney, Agent, or Firm*—McAndrews, Held & Malloy, Ltd.

[57] ABSTRACT

Switch lockouts are disclosed which may be fixed to a single toggle switch, a ganged toggle switch, or a similarly acting switch, valve operator, or similar structure to prevent the switch from being operated. The lockout comprises a projection and abutments which engage the switch handle and the body of the switch. The projection extends into an aperture of the handle in one embodiment, or under the crossbar of a ganged handle in another. The abutments, and in some instances the projection, embrace the handle and prevent substantial rotation of the handle with respect to the lockout, or of the lockout with respect to the switch body. Thus, the switch handle, switch body, and lockout are fixed substantially immovably together.

14 Claims, 2 Drawing Sheets

SWITCH LOCKOUTS

The present invention relates to a lockout which may be fixed to a toggle switch or a similarly acting device (such as a valve operator) to prevent the switch from being operated inadvertently or by an unauthorized person. The invention particularly relates to electrical circuit breaker lockouts.

BACKGROUND OF THE INVENTION

Electrical circuit breakers commonly include toggle switches for controlling the power delivered to particular circuits. Typically, the individual circuit breakers for several branch circuits are mounted in a compact array within a single housing.

In a circuit breaker of this kind, a recess is conventionally formed in each side of the switch handle. The usual recess extends perpendicularly with respect to the plane defined by the pivoting of the handle. Commonly, a switch handle has two such recesses, one on each side, separated by a web.

A ganged switch has a gang of two or more switch bodies and a handle assembly including two or more handles extending from the ganged switch body and joined by a crossbar.

A safety problem arises when the switch of a circuit breaker which controls a remote circuit is turned off so the circuit can be worked on. If one worker throws the circuit breaker switch, then goes to the remote circuit to work, others may be unaware that the corresponding circuit is being worked upon, and may turn the switch back on. The worker who is in contact with the circuit may be severely injured as a result.

Other problems can arise if a switch which is meant to stay on is turned off inadvertently. For example, if a switch controlling the power to a heating unit of a building is shut off inadvertently, the water in pipes in the building may freeze on a cold night.

Lockouts of various kinds have been physically attached to a switch or valve, and particularly to a circuit breaker switch, to maintain the handle of the switch in one state. Lockouts have often required permanent installation of special parts or other modifications of the switch body, which are undesirable (whether because work is required to install such a lockout or because installation may damage the circuit breaker or require the electrical service to the panel including the switch to be interrupted).

Other lockouts have parts which are inserted at least partially into the switch body. Such parts, and particularly electrically conductive parts, might themselves present an electrical shock hazard.

OBJECTS OF THE INVENTION

One object of the invention is to provide apparatus to physically restrain the handle of a switch so it will remain in the desired state.

Another object of the invention is to provide such apparatus which is installed entirely outside the switch body.

An additional object of the invention is to provide such apparatus which can be installed without modifying the switch handle or body.

Still another object of the invention is to provide such apparatus which is made entirely of electrically nonconductive material.

Yet another object of the invention is to provide such apparatus which can be installed without the use of screws or other separate fasteners.

Even another object of the invention is to provide such apparatus which has the smallest possible number of separate parts.

A further object of the invention is to provide such apparatus which can be secured with or without a padlock while it is in use.

A still further object of the invention is to provide such apparatus which can be installed and removed quickly and easily.

Yet another object of the invention is to provide such apparatus which is inexpensive enough and portable enough to easily be carried in an electrician's toolbox.

One or more of the preceding objects, or one or more other objects which will become plain upon consideration of the present specification, are satisfied by the invention described herein.

SUMMARY OF THE INVENTION

One aspect of the present invention is a new lockout adapted for attachment to the handle of a switch to maintain it at one extremity of travel, and thus to maintain the switch in one electrical state. The lockout comprises first and second abutments and a projection which engage a switch handle and a third abutment which engages the body of the switch. The abutments and the projection are fixed, relative to each other. The abutments and projection are preferably parts of a relatively rigid, one-piece lockout body which can be formed as a single piece in a two-part mold.

The projection extends into an aperture of the handle substantially perpendicularly with respect to a plane defined by the normal path the handle follows when it is switched. The projection is sized and located to fit into one of the apertures typically provided on the handle of a circuit breaker switch.

The first abutment and the second abutment embrace the handle between them and prevent substantial rotation of the handle with respect to the lockout. The third abutment abuts the switch body to prevent substantial rotation of the lockout with respect to the switch body. Thus, the handle, body, and lockout are fixed substantially immovably together, substantially freezing the switch handle in place with respect to the switch body.

Another aspect of the invention is a lockout specially adapted for attachment to the handle assembly of a ganged switch. This lockout includes a lockout body, a slide, and a way to fix the slide with respect to the body.

The lockout body includes a first abutment for abutting a surface of the handle assembly of the switch and a second abutment for abutting the ganged switch body.

The slide is captured with respect to the lockout body for sliding between first and second positions. The slide has a projection positioned to engage the crossbar of the switch handle and a third abutment opposed to the first abutment of the lockout body.

The slide and body of the lockout cooperate to prevent rotation of the switch handle with respect to the lockout body, and rotation of the lockout body with respect to the switch body, when the slide is in its first position. When the slide is in its second position, the lockout is released from the switch and can be installed on the switch or removed from the switch.

The structure for retaining the slide in its first position can be variously configured. One example is an aperture in the slide which protrudes from the lockout body and thus is accessible to receive a pin, lock hasp, seal, or similar member only when the slide is in its first position.

DETAILED DESCRIPTION OF THE INVENTION

While the invention will be described in connection with one or more preferred embodiments, it will be understood that the invention is not limited to those embodiments. On the contrary, the invention includes all alternatives, modifications, and equivalents as may be included within the spirit and scope of the appended claims.

Figure 1:
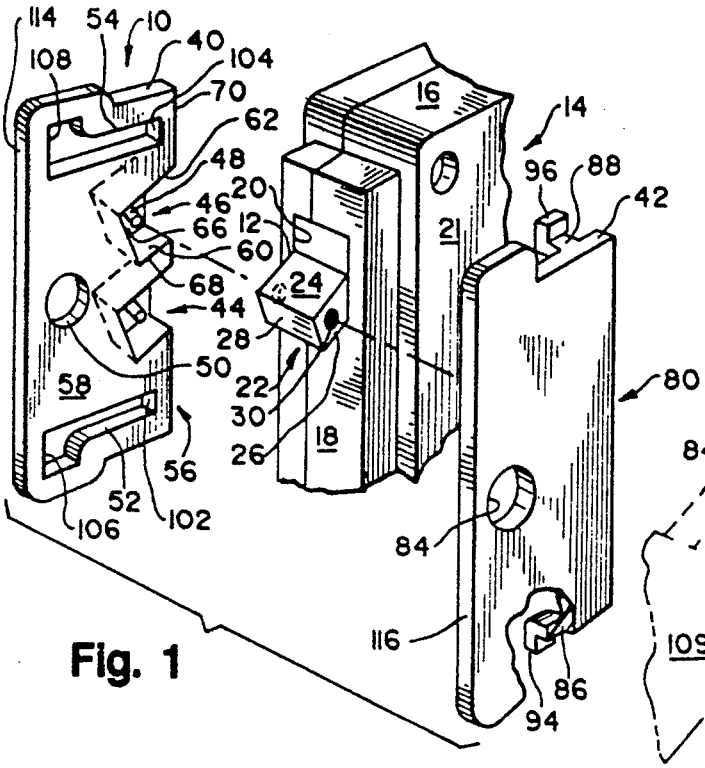
FIG. 1 is an exploded perspective view of a first embodiment of a lockout according to the present invention, and of the switch on which it is to be installed.

Referring first to FIG. 1, the lockout generally indicated at 10 is for temporary attachment to the handle 12 of a switch 14. The switch 14 comprises a body 16 including a switch plate 18 having an aperture 20 through which the handle 12 extends to the exterior of the switch. The handle 12 is normally pivotable between first and second extremities of travel. The pivot of the handle 12 is recessed within the body 16.

Conventionally, when the handle 12 is at one extremity of travel (for example, when the handle 12 is up) the switch is on and makes an electrical connection. When the handle 12 is at its other extremity of travel (for example, when the handle is down, as shown in FIG. 1), the switch is off and breaks the same electrical connection.

The path swept by the handle 12 as it is switched between its two extremities of travel defines a first plane. This first plane is parallel to the side face 21 of the switch 14. This first plane is relevant to the orientation of other parts of the switch 14 and the lockout 10.

In FIG. 1, the handle 12 is at its first extremity of travel. It has a first or lower surface 22 (shown in phantom) facing in the direction of the first extremity of travel of the switch 14. The handle 12 has a second or upper surface 24 facing the second extremity of travel of the switch 14. The handle 12 also has side surfaces such as 26, a front surface 28, and a recess 30 which extends substantially perpendicularly with respect to the first plane defined by the path of the handle 12. The recess 30 may extend from one side surface 26 to the other. In the usual handle 12 as manufactured, however, a thin web separates the recess 30 into two longitudinally separated coaxial portions.

In an electrical circuit breaker box, the circuit breakers commonly are mounted in tight rows with little or no space between them. For this reason, the lockout 10 preferably is very narrow, so it will extend minimally laterally past the side faces such as 21 of the switch 14 when the lockout 10 is in place. Otherwise, either the lockout 10 might not be usable on an assembled array of switches, or two lockouts 10 might not fit on two adjacent switches such as 14 at the same time.

The lockout 10 will now be described, with reference to FIGS. 1-6. The lockout 10 generally comprises a first element 40 and a second element 42. Each of the elements 40 and 42 can be one piece.

The first element 40 includes recesses 44 and 46, a projection 48, an eye 50, slots 52 and 54, a front face 56 (also known as a third abutment), and a side face 58. The recesses 44 and 46 open to the front face 56 and the side face 58. The recesses 44 and 46 and the projections such as 48 within the recesses are respectively adapted to receive switch handles 12 of different sizes. Only the recess 46 and its projection 48 will be described directly here; the recess 44 and its projection are identical except for their sizes and positions. Separate recesses 44 and 46 are provided so a single lockout 10 can be used on switches 14 of two different sizes.

The recess 46 for receiving the switch handle 12 has first and second interior walls (also referred to herein as first and second abutments) 60 and 62, a back wall 64, and a side wall 66. The opposite side 68 of the recess 46 is open to pass the handle 12 when the first element 40 is installed or removed.

The first element 40 (also called the lockout body herein) is installed on a switch 16 to be protected by first aligning the element 40 with its side face 58 facing the handle 12 and with its third abutment 56 parallel to and substantially flush with the switch plate 18. At the same time, the projection 48 and the recess 30 are registered. The first element 40 is then translated along the axis of the projection 48 until the side surface 26 of the handle 12 is substantially in contact with the side wall 66. As a result, the projection 48 is inserted into the aperture 30.

When the first element 40 is installed on a switch 14, its first abutment 60 abuts the first (lower) surface 22 of the handle 12, while the second abutment 62 abuts the second (upper) surface 24 of the handle 12. At the same time, the third abutment 56 abuts the switch plate 18, and the projection 48 extends into the recess 30 substantially perpendicularly with respect to the first plane previously described. ("Substantially perpendicularly" as used herein does not require that the projection 48 and the recess 30 must be precisely perpendicular to the plane defined by the travel of the switch handle 12, providing they are near enough to perpendicular to engage in the manner described here.) The first, second, and third abutments 60, 62, and 56 and the projection 48 are fixed, relative to each other, because they are all part of the substantially rigid first element 40.

Once the first element 40 is thus installed, its first and second abutments 60 and 62 respectively abut the surfaces 22 and 24 of the handle 12 in its first extremity of travel. Looking at the situation slightly differently, the handle 12 is confined and restrained by the closely conforming internal surfaces of the recess 46.

The first element 40 functions as follows. When the first element 40 is in place as described immediately above, the first and second abutments 60 and 62 embrace the handle 12 between them and prevent substantial rotation of the handle 12 relative to the first element 40. The projection 48 locates the third abutment 56 substantially flush with the switch plate 18. Attempts to manipulate the handle 12 by pulling on the first element 40 and biasing the handle 12 toward its second extremity of travel will cause the leading edge 70 of the third abutment 56 to interfere with the switch plate 18, thus resisting the biasing force.

In the illustrated embodiment, the same first element 40 can be used to lock out the handle 12 at its second extremity of travel. To accomplish this, the first element 40 may be turned upside down, and then will fit on the handle 12 at its second extremity of travel.

Referring again to FIGS. 1-6, a second element 42 can be provided to fully envelop the switch handle 12 when the lockout 10 is installed. The second element 42 comprises a back edge 80, a surface 82 (best seen in FIGS. 4 and 5), an eye 84, legs 86 and 88, and detents 90 and 92 (best seen in FIGS. 4 and 6). The legs 86 and 88 respectively have offset feet 94 and 96.

The slots 52 and 54 of the first element 40 receive the legs 86 and 88 of the second element 42. One or both of the legs 86 and 88 and the corresponding slots 54 and 52 could be moved from the element 40 to the element 42, or vice versa, without departing from the invention.

Returning briefly to the first element 40, its slots 52 and 54 respectively have first ends 102 and 104 and second ends 106 and 108. Going from its first end such as 102 to its second end such as 106, each slot such as 52 extends away from the third abutment 56 and (when the first element 40 is in place on a switch handle 12) away from the switch plate 18. At their second ends 106 and 108, the slots 52 and 54 are large enough and correctly positioned to pass the offset feet 94 and 96.

Figure 3:
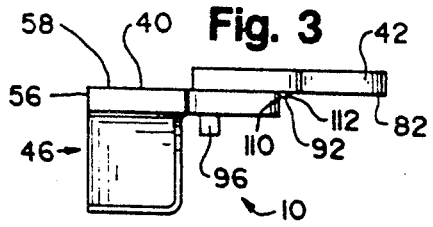
FIG. 3 is a top plan view of the lockout shown in FIG. 2, except that the elements of the lockout are displaced from their positions shown in FIG. 2.
Figure 4:
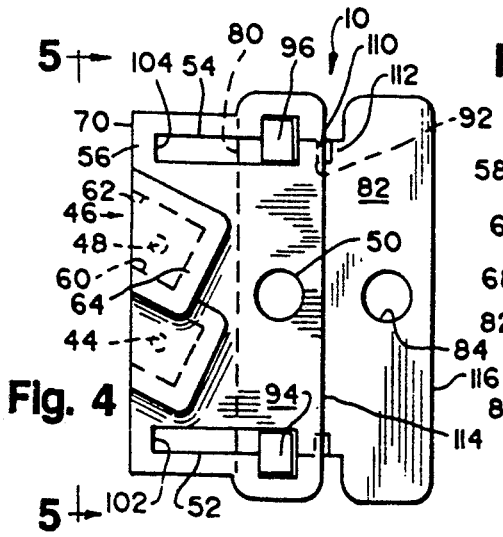
FIG. 4 is a left side elevational view of the structure shown in FIG. 3.

The feet 94 and 96 of the element 42 can be inserted through the ends 106 and 108 of the slots by advancing the surfaces 82 and 58 into abutting and parallel relation. When this is done, the second element 42 is in what is sometimes referred to herein as its second or unlocked position, as shown in FIGS. 3 and 4.

The second element 42 can be advanced toward a first or locked position (FIGS. 2, 5, and 6) by sliding the element 42 toward the switch plate 18 until the legs 86 and 88 are within the portions of the slots 52 and 54 which are too small to pass the feet 94 and 96. When the second element 42 is slid toward its first position, its feet 94 and 96 protrude and are offset from the slots 52 and 54. The feet 94 and 96 thus capture the legs 86 and 88 in the slots 52 and 54, except when the feet 94 and 96 are registered with the ends 106 and 108 of the respective slots.

Figure 2:
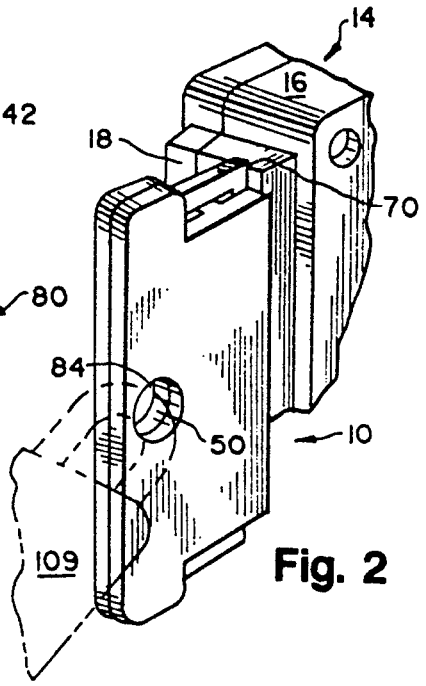
FIG. 2 is a view similar to FIG. 1, but with the lockout assembled on the switch in its operative position.
Figure 5:
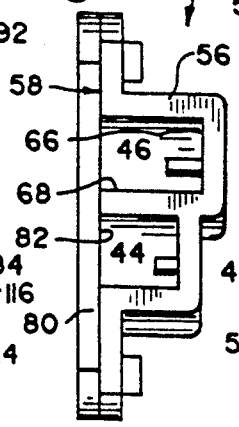
FIG. 5 is a rear elevational view taken from line 5—5 of FIG. 4.
Figure 6:
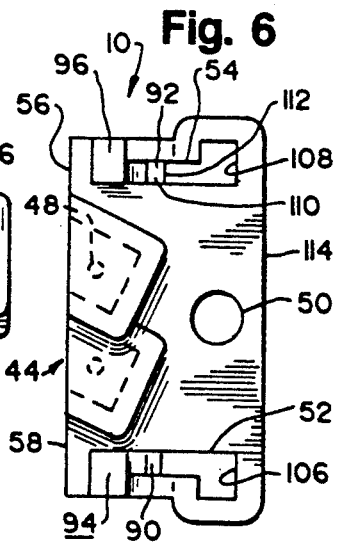
FIG. 6 is a left side elevational view of the structure shown in FIG. 2.

When the second element 42 is advanced so its legs 86 and 88 abut the ends 102 and 104 of the slots in the first element 40, the second element 42 is in its first position (FIGS. 2, 5, and 6). Its edge 80 and the third abutment 56 lie substantially in a common plane. Since the elements 40 and 42 have substantially the same profile, they are substantially registered, and the apertures 50 and 84 are in registration. The surface 82 of the second element 42 blocks the open side 68 of the recess 46, thus substantially completely enveloping the portion of the handle 12 protruding from the switch plate 18.

The registration between the eyes 50 and 84 can optionally be maintained by inserting the hasp of a padlock through them and locking the padlock. Such a padlock 109 is shown in phantom in FIG. 2. A tamper-evident seal, a pin or other fastener, a tag stating that the circuit has been locked out while it is being worked upon, or other things can also be inserted through the eyes 50 and 84. The lockout will remain in place on a switch and its presence will signal the locked out status of the switch without the need for such expedients, however.

If an attempt is now made to withdraw the first element 40 from the handle 12 by withdrawing the projection 48 from the recess 30, the surface 82 will block this withdrawal, and the feet 94 and 96 (as well as the padlock 109, if one is used) will prevent the first and second elements 40 and 42 from being separated to effect such withdrawal. Thus, a coupling is provided to removably secure the first and second elements 40 and 42 together in abutting relation to the handle 12, capturing the projection 48 in the recess 30.

A further feature of the present embodiment is the cooperation of the detents 90 and 92 of the second element 42 (FIGS. 3, 4 and 6) with the first element 40. This cooperation limits the travel of the second element 42 respecting the first element 40, so the two elements will normally remain assembled. It is useful to keep the elements 40 and 42 assembled, even when the lockout 10 is removed from the switch 14, so neither element will be lost. The detents are also designed to allow the elements 40 and 42 to be assembled and disassembled easily.

Each detent such as 92 has a ramp 110 on one side and an abutment 112 on the other side (as seen best in FIG. 3). The detents 90 and 92 are lined up with the slots 52 and 54 when the elements 40 and 42 are assembled. The second element 42 is at its first or locked position in FIG. 6, so the detents 90 and 92 are disengaged from the element 40 and are located within the slots 52 and 54. When the second element 42 is in its second position, shown in FIGS. 3 and 4, the detents 90 and 92 are again disengaged, and are located entirely out of registration with any part of the first element 40.

Referring particularly to FIG. 3, if the second element 42 is moved from the illustrated position to the left, the ramp 110 will engage the front edge 114 of the fir st element 40. Engagement of the ramp 110 urges the elements 40 and 42 slightly apart so the detents such as 92 will pass by the side face 58 of the first element 40. (The two elements of the lockout 10 are normally held substantially together because the first element 40 is captured between the surface 82 and the feet 94, 96 of the second element 42, and the clearance between these parts is minimal.) The second element 42 can be advanced toward its first position until the detents 90 and 92 drop into the slots 52 and 54. The elements 40 and 42 are regarded here as being assembled when the detents 90 and 92 are within the slots 52 and 54.

Referring particularly to FIG. 6, the detents 90 and 92 prevent accidental disassembly of the first and second elements 40 and 42. The second element 42 can be moved to the right freely only until the abutments such as 112 (seen in FIG. 3) of the detents such as 92 catch the second ends 106 and 108 of the respective slots. The feet 94 and 96 are not yet registered with the enlarged ends of the slots 52 and 54 when the detents 90 and 92 engage the slot second ends 106 and 108. Thus, the feet 94 and 96 cannot be withdrawn from the slots 52 and 54 while the detents are engaged.

The detents 90 and 92 can be released by pushing the front edge 116 of the second element 42 away from the front edge 114 of the first element 40 far enough that the detents 90 and 92 are lifted out of the slots 52 and 54. The second element 42 can then be slid to its second position and the feet 94 and 96 can be released from the enlarged ends of the slots 52 and 54.

The respective elements 40 and 42 may be made of any material which is rigid enough to maintain the relationships between the abutments and projection as previously defined, and resilient enough that the second element can be flexed away from the first element 40 sufficiently to pass the detents 90 and 92 over the face 58 of the first element 40. One suitable material for the elements 40 and 42 is moldable plastic material. The elements 40 and 42 can instead be made of wood, other non-conductive material, or (less preferably) metal.

The elements 40 and 42 each can be molded in a single, two-part mold. Instead of being molded, however, the elements of the preferred embodiment can be machined from a solid block of material or assembled from discrete parts.

Instead of the two legs and two horizontal slots of the illustrated embodiment, a single horizontal slot, preferably near the center of the element bearing it, could be provided and two horizontally spaced legs such as 94 and 96 could be provided in the single slot to prevent relative rotation of the elements 40 and 42.

The lockout can also be made wider than the width of a single switch 14, so a plurality of ganged switches or adjacent switches can be locked out simultaneously. In yet another embodiment, the first and second elements 40 and 42 could be temporarily or permanently fastened together by screws, rivets, glue, or heat sealing, or the like. If the fastening was permanent, one would need to damage the lockout to remove it. In this embodiment, the lockout itself would act as a tamper-evident seal.

In still another possible variation, the feet 94 could be formed after the legs 86 and 88 are inserted in the slots 52 and 54. In that embodiment, the slots 52 and 54 would not require enlarged ends 106 and 108. The first and second elements could thus be permanently captured together.

In yet another variation, the second element 42 could be omitted, and either the first element 40 could be used alone or a set screw or some other fastening could be provided to secure it to some element of the switch body 16 or handle 12.

Many other variations and modifications will readily occur to one of ordinary skill in the art who is aware of the present disclosure.

Referring now to FIGS. 7–13, a second embodiment of the invention is disclosed. This embodiment is particularly adapted to lock out a ganged switch assembly in which two or more switch handles are bridged by a crossbar.

Figure 7:
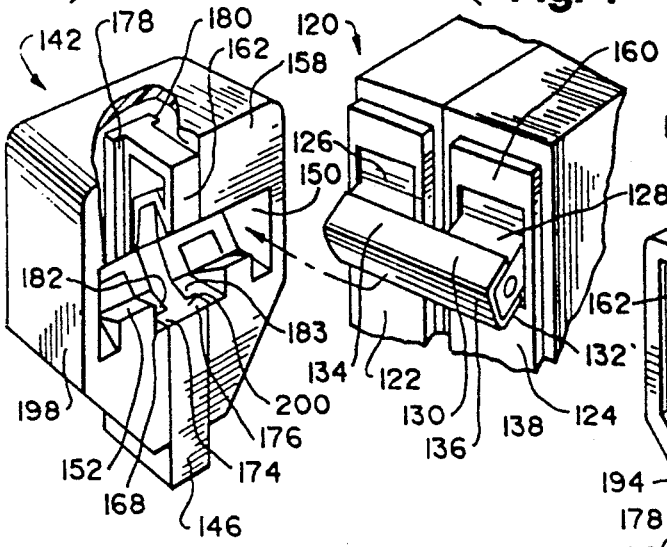
FIG. 7 is a perspective view of a second embodiment of the invention, shown adjacent to a ganged switch which can be locked out.

FIG. 7 shows a ganged switch generally indicated at 120, which is an assembly of the switch bodies 122 and 124 and their respective switch handles 126 and 128. The bodies 122 and 124 are fixed together. The handles 126 and 128 are joined by a crossbar 130. The handle assembly, considered as a unit, has first and second surfaces 132 and 134 facing its corresponding extremities of travel, an end surface 136, and side surfaces such as 138.

The lockout 142 for a ganged switch comprises a body 144 and a slide 146. The body 144 comprises a recess generally indicated at 150 for receiving the handle assembly of the switch 120. The recess 150 is adapted to closely conform to the outer dimensions of the handle assembly. Specifically, the recess 150 includes an abutment 152 (FIG. 7) for facing the first surface 132, a surface 154 (FIG. 11) for facing the second surface 134 of the handle assembly, and a surface 156 for facing the end surface 136 of the handle assembly. The lockout body 144 further comprises an abutment 158 for bearing against the switch plate 160 of the ganged switch body 120.

The slide 146 has a hooked end 162 for engaging the crossbar 130 and a second end 164 for receiving a member, such as the hasp of a padlock, in its aperture 166. The slide 146 is generally I-shaped in cross-section, comprising a center web 172 and flanges 174, 176, 178, and 180. The flanges 174 and 176 of the slide 146 are guided by the shoulders 182 and 183 of the body 144. The flanges 178 and 180 of the slide 146 are guided by the shoulders 184 and 185 of the body 144. These flanges and shoulders limit the travel of the slide 146 to linear sliding.

Figure 8:
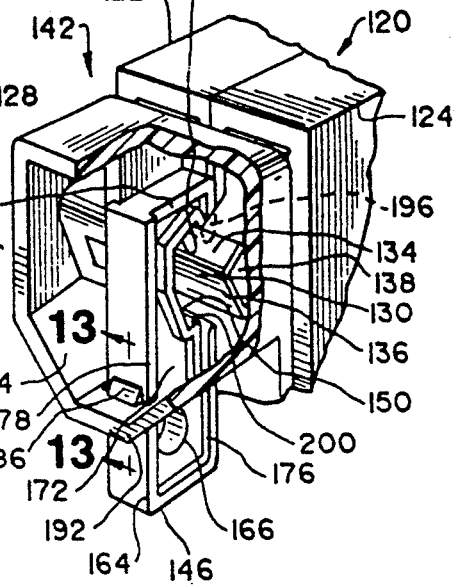
FIG. 8 is a cutaway perspective view of the second embodiment of the invention, engaged with the crossbar of a ganged switch.
Figure 9:
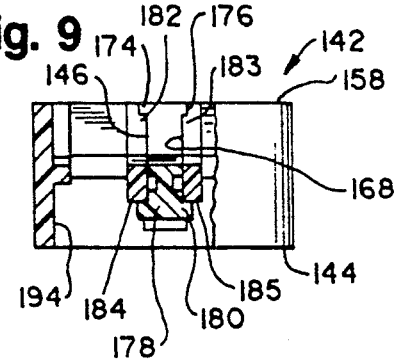
FIG. 9 is a cutaway bottom plan view of the second embodiment.
Figure 13:
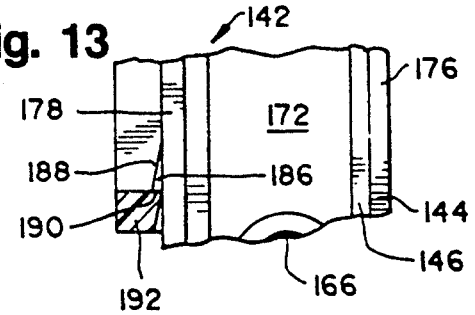
FIG. 13 is an enlarged section taken along line 13—13 of FIG. 8.
Figure 10:
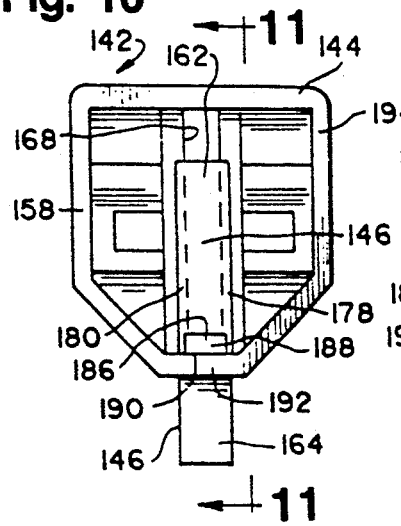
FIG. 10 is a front elevational view of the second embodiment.

In this embodiment, the slide 146 is essentially permanently captured within the body 144 by a detent 186, seen in detail in FIG. 13 and on a smaller scale in FIGS. 8 and 10. Referring to FIG. 13, the detent 186 comprises a ramp 188 and an abutment 190. The detent 186 interacts with a bridge 192 forming part of the peripheral shell 194 of the body 144.

The slide 146 and body 144 can be made as separate moldings or other parts, then assembled by sliding the slide 146 into the body 144 so the ramp 188 of the detent 186 is driven under the bridge 192 and out the other side, to the position shown in FIGS. 8, 10, and 13. The slide 146 is then effectively captured: an attempt to withdraw it will cause the abutment 190 to be caught by and bear against the bridge 192.

Figure 11:
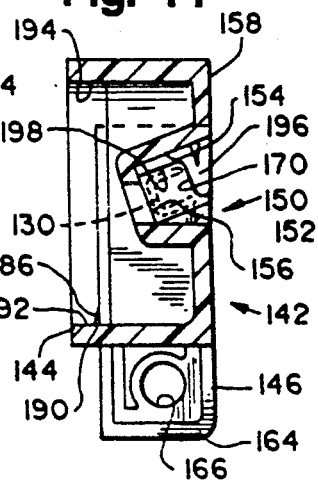
FIG. 11 is a section taken along line 11—11 of FIG. 10.
Figure 12:
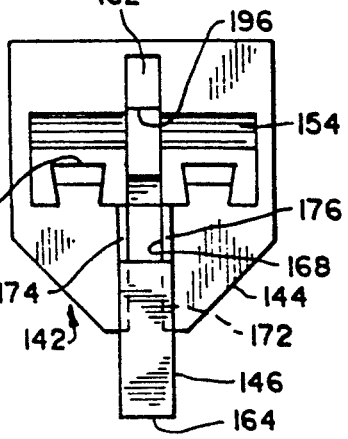
FIG. 12 is a rear elevational view of the second embodiment.

Look now at the switch handle engaging end 162 of the slide 146. The end 162 includes a projection 196 adapted to hook under the crossbar 130 of the switch, a surface 198 for bearing against the crossbar 130, and an opening 200 large enough to admit the crossbar 130. When the slide 146 is in its second or disengaged position, best illustrated in FIG. 7, the projection 196 and the surface 198 are essentially flush with or recessed in the surface of the abutment 154 (FIG. 11). The recess 150 is thus unobstructed, and can be slipped over the handle assembly of a ganged switch 20 so the abutment 158 abuts the switch plate 160.

The slide 146 can be slid from its disengaged position as illustrated in FIG. 7 to its first or engaged position as illustrated in FIGS. 8 and 11. This shift of the slide 146 brings the end 162 of the slide 146, and particularly the projection 196 and the surface 198, into engagement with the crossbar 130. The same shift also urges the surface 132 of the handle assembly against the abutment 152. These engagements fix the crossbar 130 to the body 144 of the lockout, preventing rotation of one with respect to the other. The abutment 158 is also held against the switch plate 160, thus preventing the body 144 from being withdrawn from, or rotated with respect to, the switch bodies 122 and 124. The result is to fix the handles 126 and 128 and the crossbar 130, thus preventing the switch 120 from being thrown.

Finally, the arrangement for retaining the slide 146 in its first position will be described. The aperture 166 of the slide 146 is recessed within the channel 168 except when the slide 146 is in its first, locking position. The slide 146 can be secured in its locking position by inserting through the aperture 166 something which will prevent the slide 146 from being withdrawn into the channel 168. A pin, fastener, or other member will suffice, but for greater security it is preferred that a padlock be used for this purpose. The same result could also be achieved by providing an aperture 166 which remains at all times recessed within the channel 168, and by providing holes through the channel 166 and slide 146 which come into registration when the slide 146 is in its first position. Another expedient for accomplishing the same result would be a latch engaging between the slide 146 and the body 144.

A new lockout is thus provided which is adapted for attachment to the handle of a switch to maintain it at one extremity of travel, and thus to maintain the switch in one electrical state. The lockout body can be formed as a single piece in a two-part mold. The present apparatus can be installed quickly, easily, and entirely outside the switch body. The apparatus can be installed without modifying the switch handle or body, and without the use of screws or other discrete fasteners.

What is claimed is:

1. A lockout adapted for attachment to the handle of a switch to maintain it at one extremity of travel, wherein the handle of the switch extends from a switch body; is normally pivotable between first and second extremities of travel along a path which defines a plane; has a first surface facing the first extremity of travel and a second surface facing the second extremity of travel; and has a recess extending substantially perpendicularly with respect to the plane; said lockout comprising:

A. a first abutment for abutting the first surface of the handle;

B. a second abutment for abutting the second surface of the handle;

C. a third abutment for abutting the switch body;

D. at least one projection for extending into the handle aperture substantially perpendicularly with respect to the plane; and E. a fourth abutment for abutting the handle opposite said projection, said fourth abutment having an engaged position for preventing said projection from being fully withdrawn from the handle aperture and a disengaged position allowing said projection to be withdrawn fully from the handle aperture, said fourth abutment being movable between said engaged position and said disengaged position generally parallel to the plane;

wherein said first, second, and third abutments and said projection can be at least temporarily fixed, relative to each other, in said abutting and extending positions.

2. The lockout of claim 1, wherein said projection is a part of a first element.

3. The lockout of claim 1, wherein said first, second, and third abutments are parts of a first element.

4. The lockout of claim 3, wherein said fourth abutment is a second element which is removably secured to said first element.

5. The lockout of claim 3, wherein said first and second abutments and said projection are configured to engage a handle of a first size, said lockout further comprising:

A. a fifth abutment for abutting the first surface of a handle of a second size;

B. a sixth abutment for abutting the second surface of the handle of a second size;

C. at least a second projection for extending into the aperture of the handle of a second size substantially perpendicularly with respect to the plane; and E. wherein said third, fifth, and sixth abutments and said second projection can be at least temporarily fixed, relative to each other, in said abutting and extending positions.

6. A lockout adapted for attachment to the handle of a switch to maintain it at one extremity of travel, wherein the handle of the switch extends from a switch body; is normally pivotable between first and second extremities of travel along a path which defines a plane; has a first surface facing the first extremity of travel and a second surface facing the second extremity of travel; and has a recess extending substantially perpendicularly with respect to the plane; said lockout comprising:

A. a first abutment for abutting the first surface of the handle;

B. a second abutment for abutting the second surface of the handle;

C. a third abutment for abutting the switch body, wherein said abutments define a first element;

D. at least one projection for extending into the handle aperture substantially perpendicularly with respect to the plane, wherein said first, second, and third abutments and said projection can be at least temporarily fixed, relative to each other, in said abutting and extending positions; and E. a second element which is removably secured to said first element in abutting relation to said handle and in opposition to said projection, wherein said second element has a first position abutting the switch body and a second position spaced from the switch body, and said second element is movable along said first element at least part of the way between said first and second positions.

7. The lockout of claim 6, further comprising a pair of eyes, respectively in said first element and said second element, which are registered when said second element is in said first position and are sized to receive the hasp of a padlock.

8. The lockout of claim 6, further comprising a detent releasably engaging between said first element and said second element for limiting the travel of said second element toward said second position.

9. The lockout of claim 6, wherein said first and second elements are engaged by structure which comprises:

A. at least one leg having an offset foot, said leg secured to and extending from one of said first element and said second element; and B. at least one slot in the other of said first element and said second element, said slot being adapted to extend away from said switch body and having a reduced portion sized for slidably engaging said foot when said second element is in said first position and an enlarged portion sized to pass said offset foot when said second element is in said second position.

10. The lockout of claim 9, further comprising a second said leg secured to and extending from one of said first element and said second element.

11. The lockout of claim 10, further comprising a second said slot formed in the other of said first and second elements to receive said second leg.

12. The lockout of claim 10, wherein said second leg has a second offset foot and said first and second feet are offset in different directions.

13. A lockout adapted for attachment to the portion of a switch handle extending from a switch body to maintain the switch handle at one of at least two extremities of travel, wherein the handle has a recess extending substantially perpendicularly with respect to a plane defined by the path swept by pivoting the handle between its extremities of travel, said lockout comprising:

A. a recess defined by internal surfaces closely conforming to the switch handle, said recess having an open side adapted to admit the handle;

C. an abutment fixed with respect to said recess for abutting the switch body;

D. at least one projection fixed at least substantially within said recess for extending into the handle aperture substantially perpendicularly with respect to the plane; and E. a second element removably secured to said first element at the open side of said recess, said second element being movable in a direction parallel to the plane with respect to said first element to selectively capture or release the switch handle.

14. The lockout of claim 13, wherein said second element is removably secured to said first element in abutting relation to said handle at the open side of said recess.

* * * * *